US010736402B2

(12) United States Patent
Kaiser

(10) Patent No.: US 10,736,402 B2
(45) Date of Patent: Aug. 11, 2020

(54) COSMETICS CASE

(71) Applicant: Erik A. Kaiser, Mendham, NJ (US)

(72) Inventor: Erik A. Kaiser, Mendham, NJ (US)

( * ) Notice: Subject to any disclaimer, the term of this patent is extended or adjusted under 35 U.S.C. 154(b) by 294 days.

(21) Appl. No.: 16/002,210

(22) Filed: Jun. 7, 2018

(65) Prior Publication Data

US 2019/0374007 A1 Dec. 12, 2019

(51) Int. Cl.

| | |
|---|---|
| ***A45D 40/18*** | (2006.01) |
| ***F21V 23/04*** | (2006.01) |
| ***F21V 33/00*** | (2006.01) |
| ***A45D 42/04*** | (2006.01) |
| ***A45D 40/24*** | (2006.01) |
| ***A45D 42/10*** | (2006.01) |
| ***A45D 40/22*** | (2006.01) |
| ***F21Y 115/10*** | (2016.01) |
| ***F21V 23/00*** | (2015.01) |

(52) U.S. Cl.

CPC ..... *A45D 40/18* (2013.01); *A45D 40/221* (2013.01); *A45D 40/24* (2013.01); *A45D 42/04* (2013.01); *A45D 42/10* (2013.01); *F21V 23/0485* (2013.01); *F21V 33/004* (2013.01); *A45D 2200/05* (2013.01); *F21V 23/003* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 5,025,354 | A * | 6/1991 | Kondo | A45D 33/32 362/135 |
| 5,325,961 | A * | 7/1994 | Ford | B65D 75/322 132/317 |
| 6,439,595 | B1 * | 8/2002 | Cheng | B60D 1/06 280/507 |
| 8,464,731 | B1 * | 6/2013 | Eberlein | A45D 40/221 132/301 |
| 9,220,332 | B1 * | 12/2015 | DeVito | A45D 33/006 |
| 2002/0148481 | A1 * | 10/2002 | Sheffler | A45D 40/22 132/300 |
| 2003/0173369 | A1 * | 9/2003 | Nikolaus | A45D 40/221 220/830 |
| 2003/0183240 | A1 * | 10/2003 | Manougian | A45D 33/006 132/295 |
| 2011/0061675 | A1 * | 3/2011 | McKinley | A45D 33/24 132/296 |

(Continued)

*Primary Examiner* — Britt D Hanley

(74) *Attorney, Agent, or Firm* — Steven N. Fox, Esq.

(57) ABSTRACT

The present invention is a cosmetics case for storing and applying make-up from one or more pans of make-up. The cosmetics case comprises a base unit comprising a compartment the pans of make-up, a mounting portion, and a hinge rotatably engaged with the mounting portion. The cosmetics case further comprises a lighted mirror unit comprising a mirror and a plurality of light emitting diodes adapted to emit light from the mirror. The lighted mirror unit is rotatably engaged with the hinge of the base unit between a closed position where the lighted mirror unit is resting upon the base unit with the mirror and light emitting diodes facing away from the compartment and an open position where said compartment is exposed and the mirror and light emitting diodes face an open area above the compartment.

12 Claims, 8 Drawing Sheets

(56) References Cited

U.S. PATENT DOCUMENTS

| | | | | |
|---|---|---|---|---|
| 2012/0174339 | A1* | 7/2012 | Novin | E05D 3/02 16/334 |
| 2015/0201733 | A1* | 7/2015 | Brogoitti | A45D 33/22 132/288 |
| 2016/0075475 | A1* | 3/2016 | Apodaca | A45D 33/008 220/6 |
| 2016/0157583 | A1* | 6/2016 | Winter | A45F 3/18 215/227 |
| 2016/0224057 | A1* | 8/2016 | Ecker | G06F 1/1601 |
| 2017/0086560 | A1* | 3/2017 | Pires | A45D 33/24 |

* cited by examiner

COSMETICS CASE

BACKGROUND OF THE INVENTION

Cosmetic cases are widely used to store make-up. Such conventional cosmetics cases have several drawbacks. For example, such conventional cosmetic cases are not well suited for applying make-up in the dark and are not ergonomically desirable.

SUMMARY OF THE INVENTION

One object of the present invention was to develop a cosmetics case that could be easily used by a person for beauty applications such as storing and applying make-up in the dark.

The present invention is a cosmetics case for storing and applying make-up from one or more replaceable pans of make-up. The cosmetics case comprises a base unit comprising a compartment for storing the pans of make-up, a mounting portion, and a hinge engaged with the mounting portion. The cosmetics case further comprises a lighted mirror unit comprising a mirror and a plurality of light sources adapted to emit light from the mirror. The lighted mirror unit is engaged with the hinge of the base unit between a closed position where the lighted mirror unit is resting upon the base unit with the mirror and light sources facing away from the compartment and an open position where said compartment is exposed and the mirror and light emitting diodes face an open area above the compartment. With the cosmetics case of the present invention, a person can easily turn on the light sources, move the lighted mirror unit to a desired position, and apply make-up from the pans of make-up stored in the compartment with the aid of the mirror.

BRIEF DESCRIPTION OF THE DRAWINGS

The following description of the invention will be more fully understood with reference to the accompanying drawings in which.

DESCRIPTION OF THE INVENTION

Figure 2:
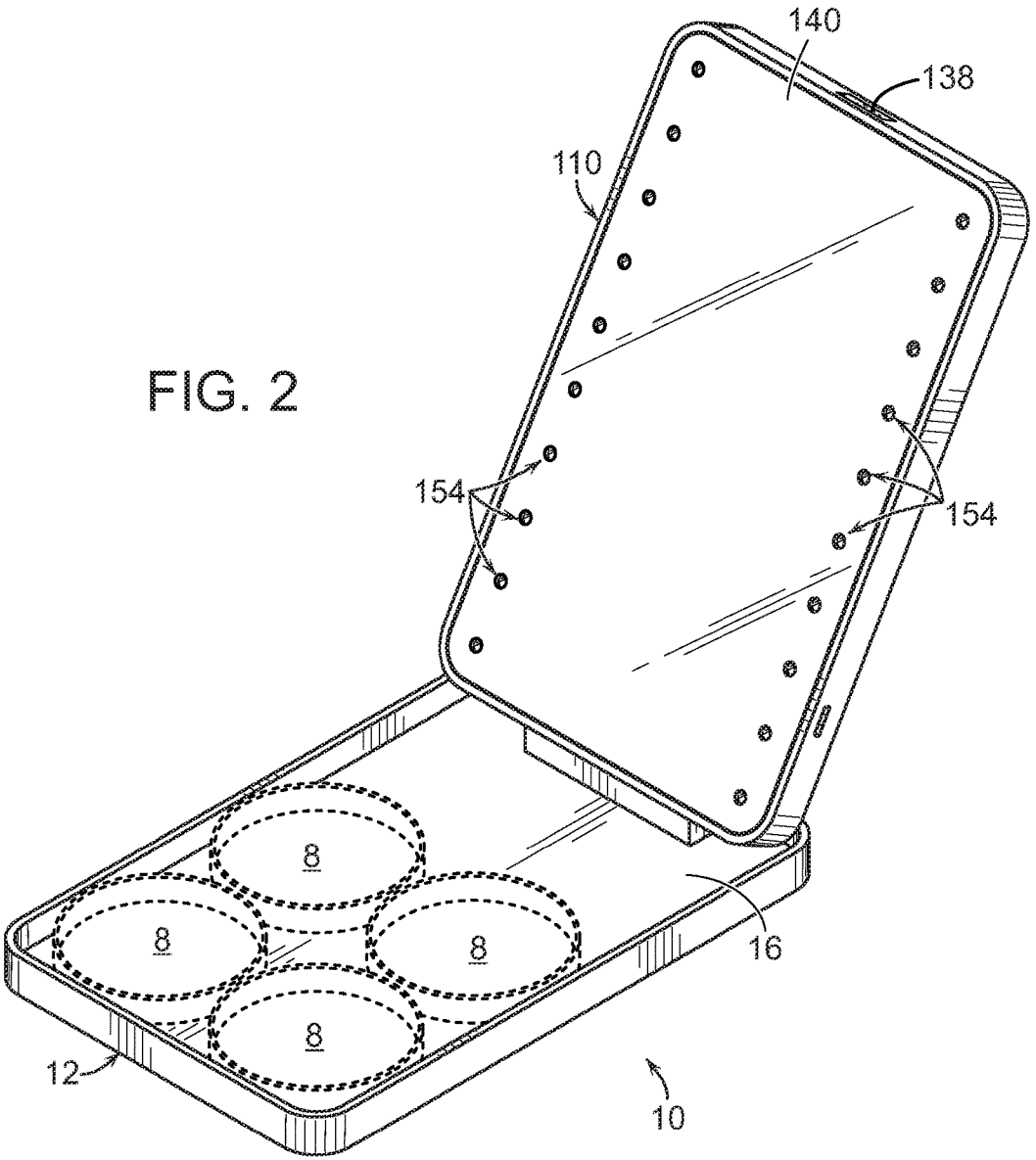
FIG. 2 is a perspective view of a cosmetics case according to the present invention shown in one of several open positions where the lighted mirror unit faces an open area above compartment of the base unit that may be stored with replaceable pans of make-up.
Figure 1:
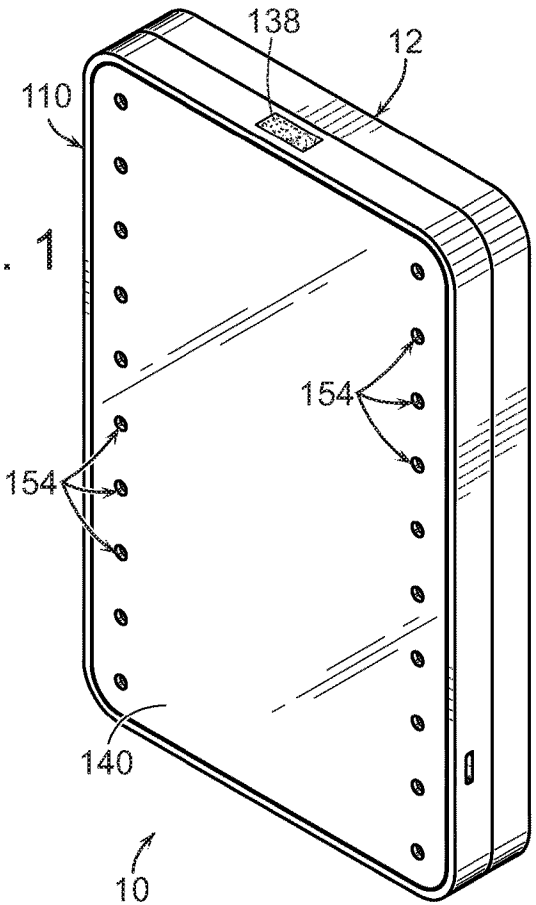
FIG. 1 is a perspective view of a cosmetics case according to the present invention shown in a closed position where a lighted mirror unit is exposed and rests upon a base unit.
Figure 3:
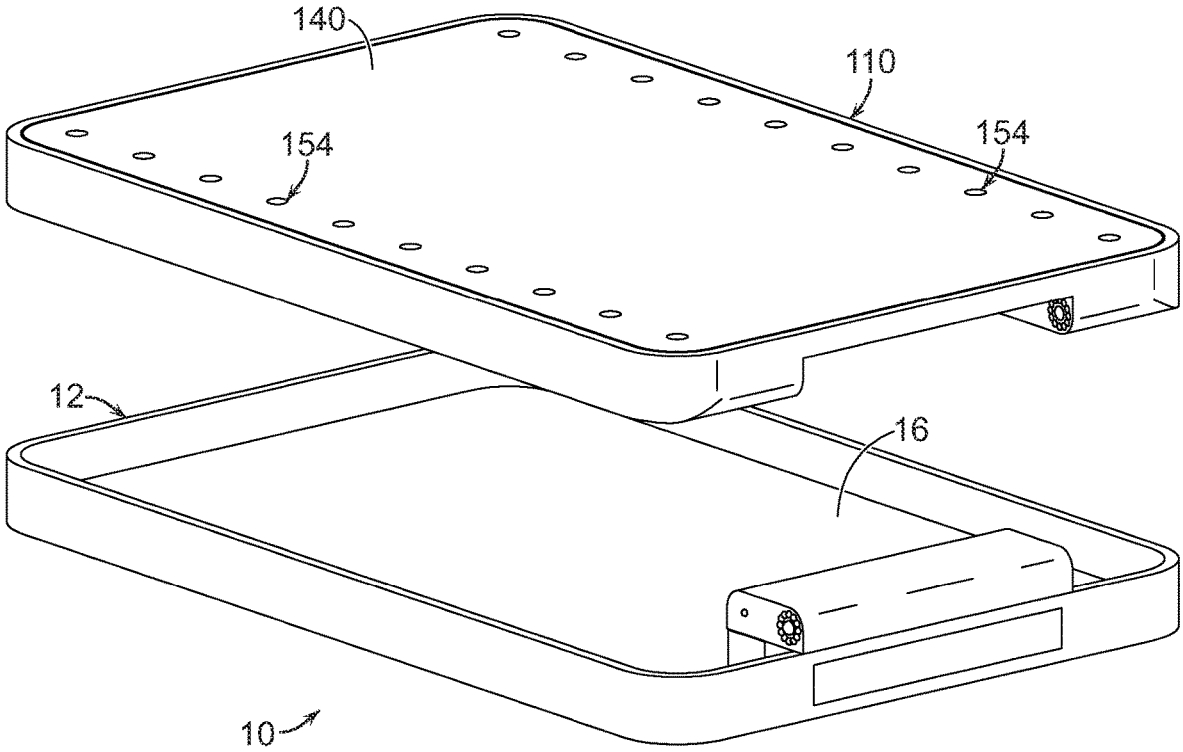
FIG. 3 is an exploded view of the cosmetics case showing the base unit and lighted mirror unit.

Referring to FIGS. 1-3, the present invention is a cosmetics case 10 that may be used to store and apply pans of make-up 8 or other cosmetics. Case 10 generally comprises a lighted mirror unit 110 moveably engaged with a base unit 12 between a closed position where lighted mirror unit 110 encloses base unit 12 (FIG. 1) and one of many open positions, for example, where a mirror 140 and a plurality of light sources 154 of lighted mirror unit 110 face an open area above compartment 16 of base unit 12 having one or more replaceable pans of make-up 8 (FIG. 2) which is substantially illuminated by light sources 154. With cosmetics case 10 of the present invention, a person can easily turn on light sources 154 by touching a button mark 138 (to be described) and move lighted mirror unit 110 to a desired position. Thereafter, the person may apply make-up from the pans of make-up 8 stored in compartment 16 with the aid of the mirror 140 in a lighted or dark environment. Pan of make-up 8 is ideally made of metal so it can be removably secured to a magnetic floor 78 (to be described) of base unit 12. Alternatively, pan of make-up 8 may have a plastic housing with a metal sheet adhered to the plastic pan or the pan of make-up 8 could have no metal and be freely stored in compartment 16.

Figure 4:
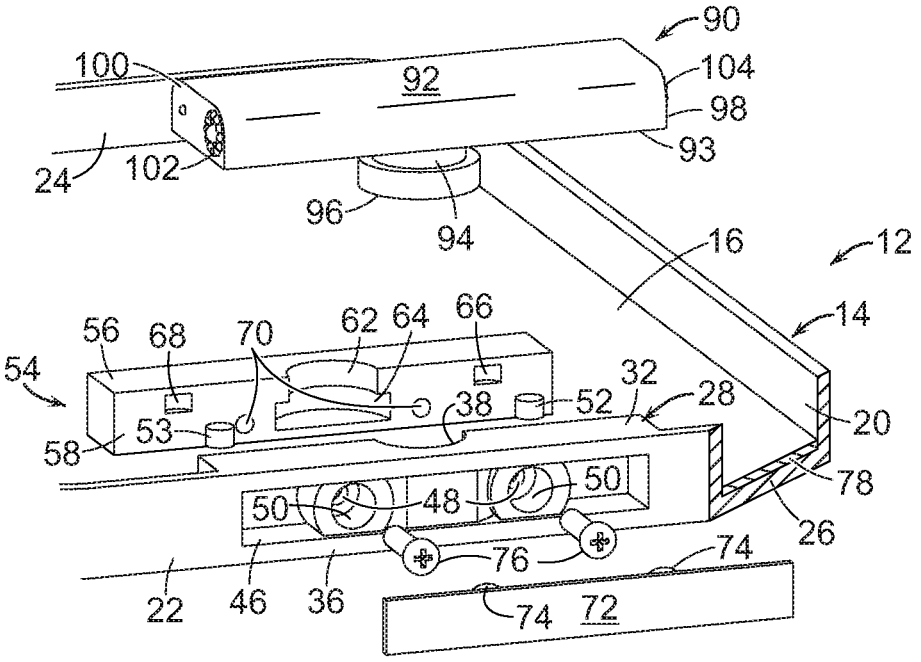
FIG. 4 is an exploded view of the base unit showing a housing comprising a compartment to store the pans of make-up, a mounting portion, and a hinge.
Figure 5:
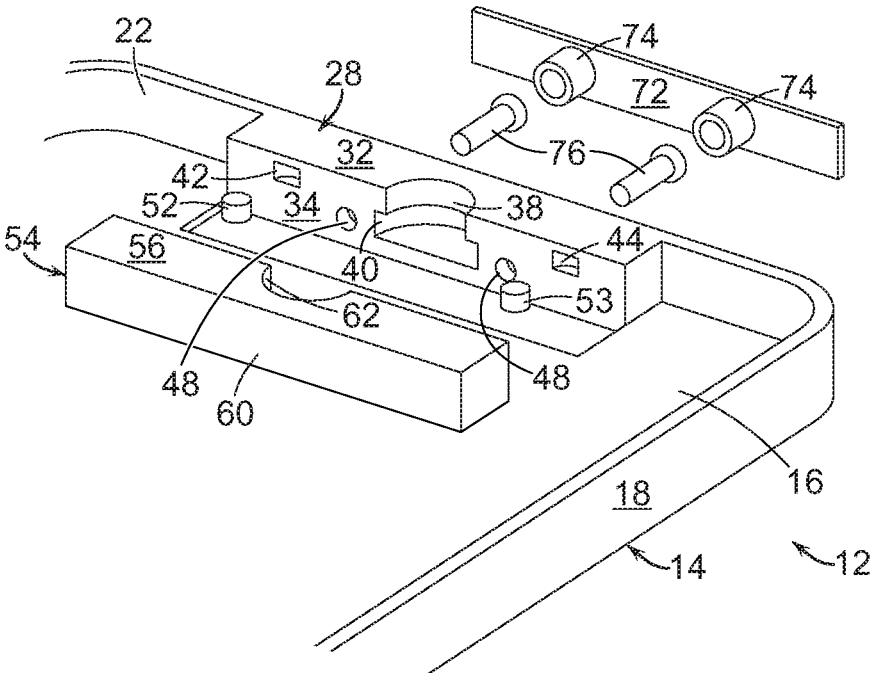
FIG. 5 is an exploded view of the base unit showing the housing with the compartment to store the pans of make-up, the mounting portion, and the hinge.

Referring to FIGS. 4-5, base unit 12 generally comprises a housing 14 comprising compartment 16 and a mounting portion 28 disposed at the bottom of housing 14 and adjacent compartment 16. Base unit 12 further comprises a retaining member 54 that engages with mounting portion 28, a cover 72 that engages with mounting portion 28, and a hinge 90 rotatably engaged with mounting portion 28. Compartment 16 is used to store a variety of items, including but not limited to replaceable pans of make-up 8 (FIG. 2). Compartment 16 comprises a left wall 18, a right wall 20, a bottom wall 22, a top wall 24, and a floor 26. Base unit 12 further comprises a magnetic floor 78 secured to floor 26 by conventional means such as adhesive. Magnetic floor 78 may be made from any magnetized material such as steel and fabricated by well known processes.

With continued reference to FIGS. 4-5, mounting portion 28 comprises an upper surface 32, an inside surface 34, and an outside surface 36. Mounting portion 28 further comprises a hole 38 and a cavity 40 in communication with hole 38 that allows free rotation of hinge 90 by a head 96 (to be described) and a neck 94 (to be described) of hinge 90. Mounting portion 28 further comprises a cavity 42 to receive a magnet 52. Mounting portion 28 further comprises a cavity 44 to receive a magnet 53. Mounting portion 28 further comprises a cavity 46 exposing a pair of through holes 48 that each receive a screw 76 to secure retaining member 54 to mounting portion 28. Mounting portion 28 further comprises a pair of counter bore or plug holes 50 surrounding through holes 48 that each receive a post 74 of cover 72 to close or hide cavity 46. Housing 14 with mounting portion 28 may be made from plastic and fabricated by well known processes.

With continued reference to FIGS. 4-5, retaining member 54 comprises an upper surface 56, an inside surface 58, and an outside surface 60. Retaining member 54 further comprises a hole 62 leading to a cavity 64 that allows free rotation of a neck 94 (to be described) and head 96 (to be described) of hinge 90. Retaining member 54 further comprises a cavity 66 to enclose magnet 52. Retaining member 54 further comprises a cavity 68 to enclose magnet 53. Retaining member 54 further comprises holes 70 to receive screws 76 to secure retaining member 54 to mounting portion 28. Retaining member 54 may be made from plastic and fabricated by well known processes.

Figure 6:
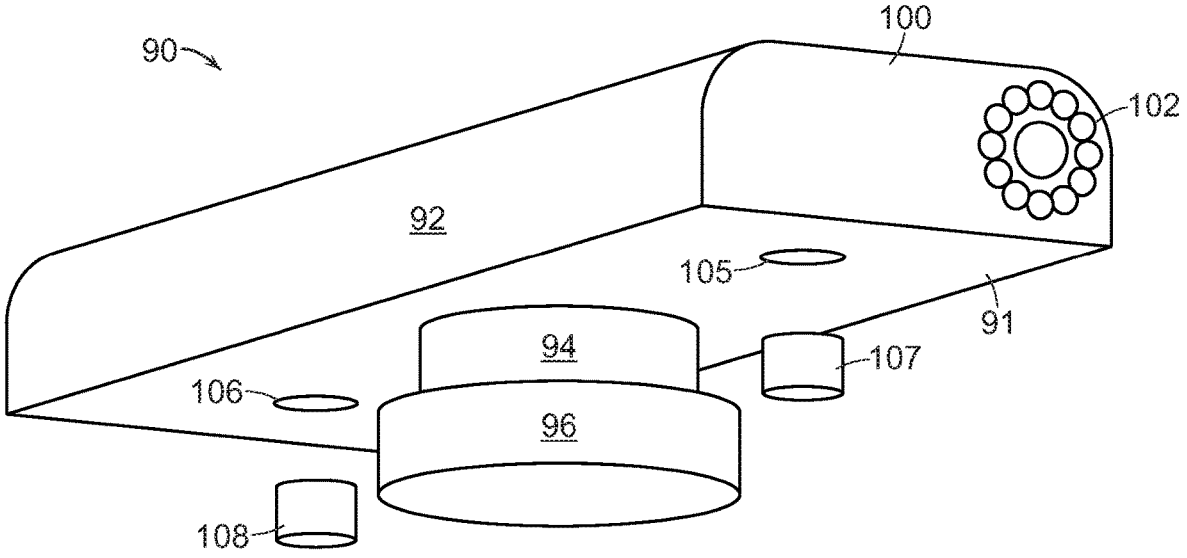
FIG. 6 is a left perspective view of the hinge showing a plurality of out-dents on a right end portion of the hinge.
Figure 7:
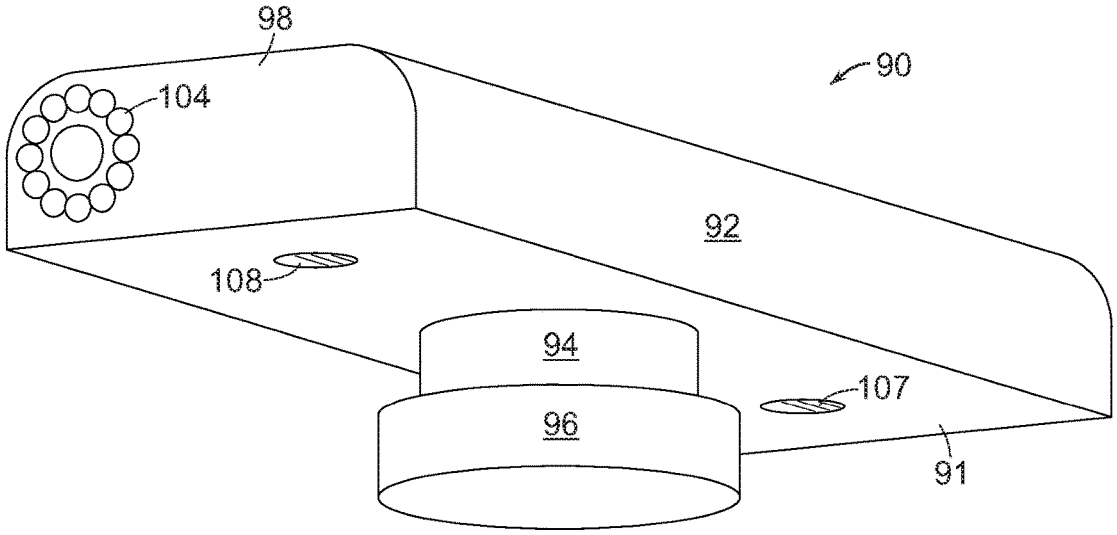
FIG. 7 is a right perspective view of the hinge showing a plurality of out-dents on a left end portion of the hinge.

Referring to FIGS. 6-7, hinge 90 comprises a body 92 comprising a neck 94 and a circular shaped head 96. Body 92 further comprises a left end portion 98 and a right end portion 100. Hinge 90 further comprises a plurality of out-dents 102 formed on left end portion 98 and a plurality of out-dents 104 formed on right end portion 100. As will be described more fully herein, out-dents 102 and 104 allow lighted mirror unit 110 (FIG. 3) to be rotated with respect to hinge 90. Hinge 90 further comprises hole 105 that receives a magnet 107. Hinge 90 further a comprises hole 106 that receives a magnet 108. Magnets 52 and 53 (FIG. 5) and magnets 107 and 108 are provided so that hinge 90 can be securely aligned with upper surface 32 of fixed member 30 (FIG. 5). When hinge 90 is rotated to an aligned position, magnet 52 is aligned with magnet 108 and magnet 53 is aligned with magnet 107. Hinge 90 my be made from plastic and fabricated by well known processes.

Figure 8:
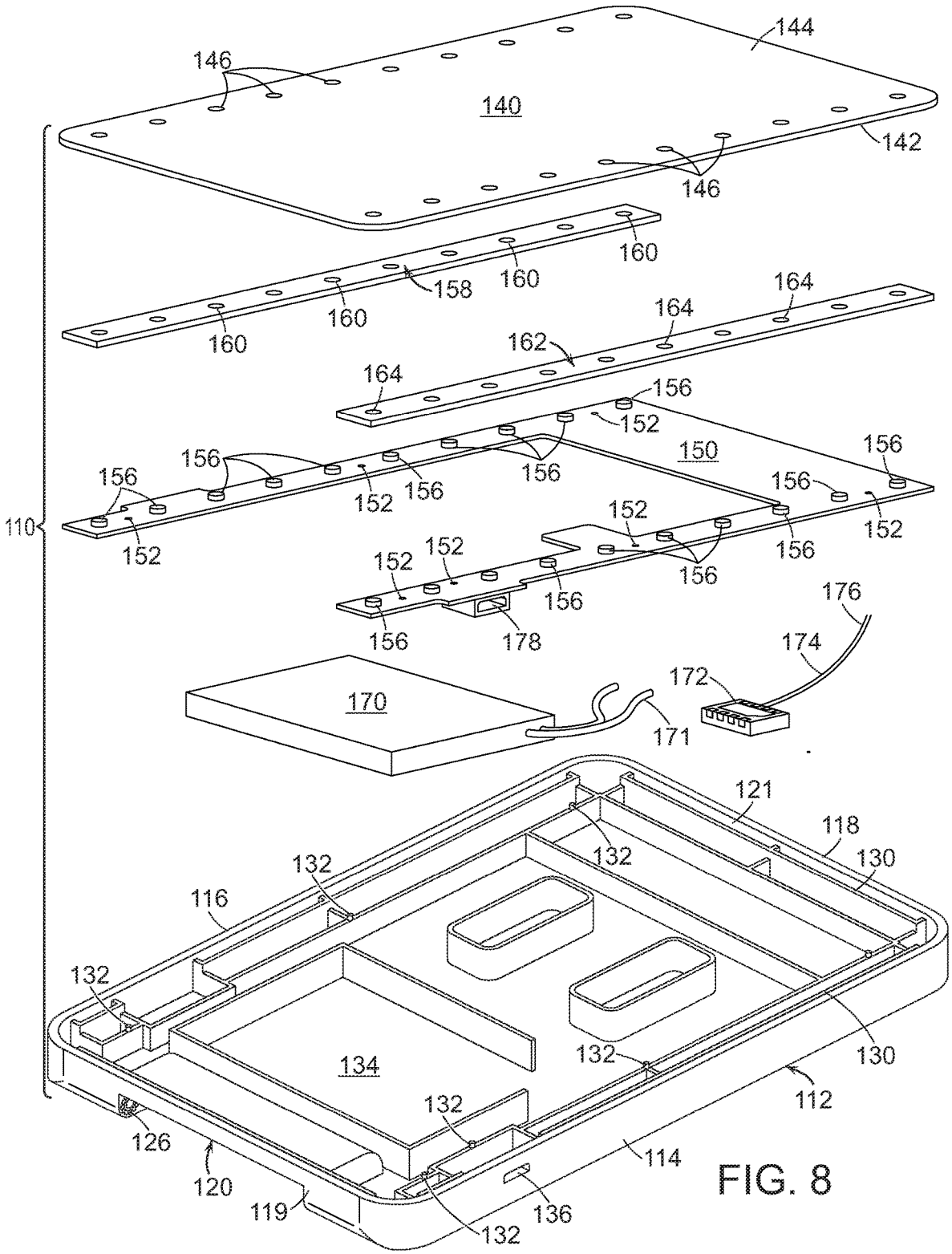
FIG. 8 is an exploded view of the lighted mirror unit showing, among other things, a housing, a mirror, a printed circuit board, a plurality of light emitting diodes, a rechargeable battery, and a capacitive touch sensor.

Referring to FIG. 8, lighted mirror unit 110 generally comprises a housing 112, a mirror 140, and a plurality of light sources 154 which in the embodiment shown are light emitting diodes 156. Lighted mirror unit 110 further comprises a printed circuit board 150 (hereinafter "PCB 150") engaged with housing 112. In the embodiment shown, PCB 150 is a double sided circuit printed board. PCB 150 comprises a plurality of mounting holes 152 that engage with a plurality of bosses, posts or protrusions 132 (to be described) of housing 112. PCB 150 is fabricated by well known processes. Each light emitting diode 156 is electrically connected to PCB 150 by conventional means such as soldering. In the embodiment shown, light emitting diode 156 may be any type of light emitting diode such as a 5050 type surface mounted light emitting diode that is widely available.

With continued reference to FIG. 8, mirror 140 of lighted mirror unit 110 is a conventional mirror having a highly shiny or mirrored rear layer 142 adhesively secured to a transparent front layer 144 made of glass. Rear layer 142 comprises a plurality of circular transparent portions or openings 146 that are etched from rear layer 142 of mirror 140 to provide a transparent medium for light to travel thru mirror 140. Each of circular transparent portions 146 of mirror 140 are aligned with and rest upon a light emitting diode 156 such that light is emitted from mirror 140. Lighted mirror unit 110 further comprises light gaskets 158 and 162 that are disposed about light emitting diodes 156 to prevent transmission of light around the sides of light emitting diodes 156 and to focus light upward thru the transparent portions 146 of mirror 140. Mirror 140 is widely available and cut to a desired size, for example, from Glass Table Top NYC, 199 Avenue T, Brooklyn, N.Y. 11223 (www-.glasstabletopnyc.com). The etching of openings 146 is done by well known processes. Light gaskets 158 and 162 comprise openings 160 and 164, respectively, to allow passage of light emitting diodes 156. Light gaskets 158 and 162 are made from an electrically non-conductive material such as plastic foam and fabricated by conventional die-cutting operations.

With continued reference to FIG. 8, lighted mirror unit 110 further comprises a rechargeable battery 170 mounted within housing 112 and electrically connected to PCB 150 to provide power for light emitting diodes 156. Battery 170 is a 3.7 volt lithium ion rechargeable battery that is widely available, for example, from Digi-Key Electronics, 701 Brooks Avenue South, Thief River Falls Minn. 56701-0677, USA (www.digikey.com) and manufactured by Adafruit Industries LLC.

With continued reference to FIG. 8, lighted mirror unit 110 further comprises a capacitive sensor 172 electrically connected to PCB 150 by conventional processes such as soldering which when activated turns power on and off to light emitting diodes 156. Sensor 162 is a touch type sensor and touching of a visual identification or button mark 138 (FIGS. 1 and 2) centrally located at the outside surface of top wall 119 of housing 112 (shown in stippling) turns on sensor 172 and light emitting diodes 156 to a first setting of low intensity. Button mark 138 can be a simple dot. Subsequent depressions of button mark 138 produce increased intensities (for example, medium and high), and a final depression turns light emitting diodes 156 off. Capacitive sensor 172 is soldered to PCB 150 by conventional processes and comprises a wire 174 having an end portion 176 that is centrally fastened to an inside surface 121 of top wall 119 of housing 112 by conductive tape (not shown) and aligned with button mark 138. Capacitive sensor 172 is widely available and provides settings for off and on. For example, sensor 172 is available from Mouser Electronics, 1000 North Main Street, Mansfield, Tex. 76063 USA (www.mouser.com) and manufactured by Microchip Technology. Sensor 172 may be any other type of switch to control the off and on operation of light emitting diodes 156.

With continued reference to FIG. 8, lighted mirror unit 110 further comprises a connector 178 disposed and aligned within an opening 136 (to be described) of housing 112 and connected to PCB 150 to allow charging of battery 170 by external sources such as an electrical outlet or other source. Connector 178 may be any type of widely available electrical connector such as a USB connector and may be soldered directly to PCB 150 by conventional soldering processes.

With continued reference to FIG. 8, lighted mirror unit 110 further comprises a micro-controller 180 (FIG. 12) mounted to PCB 150 and electrically connected with sensor 172 to control the desired setting of light emitting diodes 156, namely, low intensity, medium intensity, high intensity, and off. Micro-controller 180 may be any type of conventional controller programmed with the desired light intensity settings. By way of example only, micro-controller 180 may be a programmable micro-controller widely available, for example, from Digi-Key Electronics, 701 Brooks Avenue South, Thief River Falls Minn. 56701-0677, USA (www-.digikey.com) and manufactured by Microchip Technology.

Figure 9:
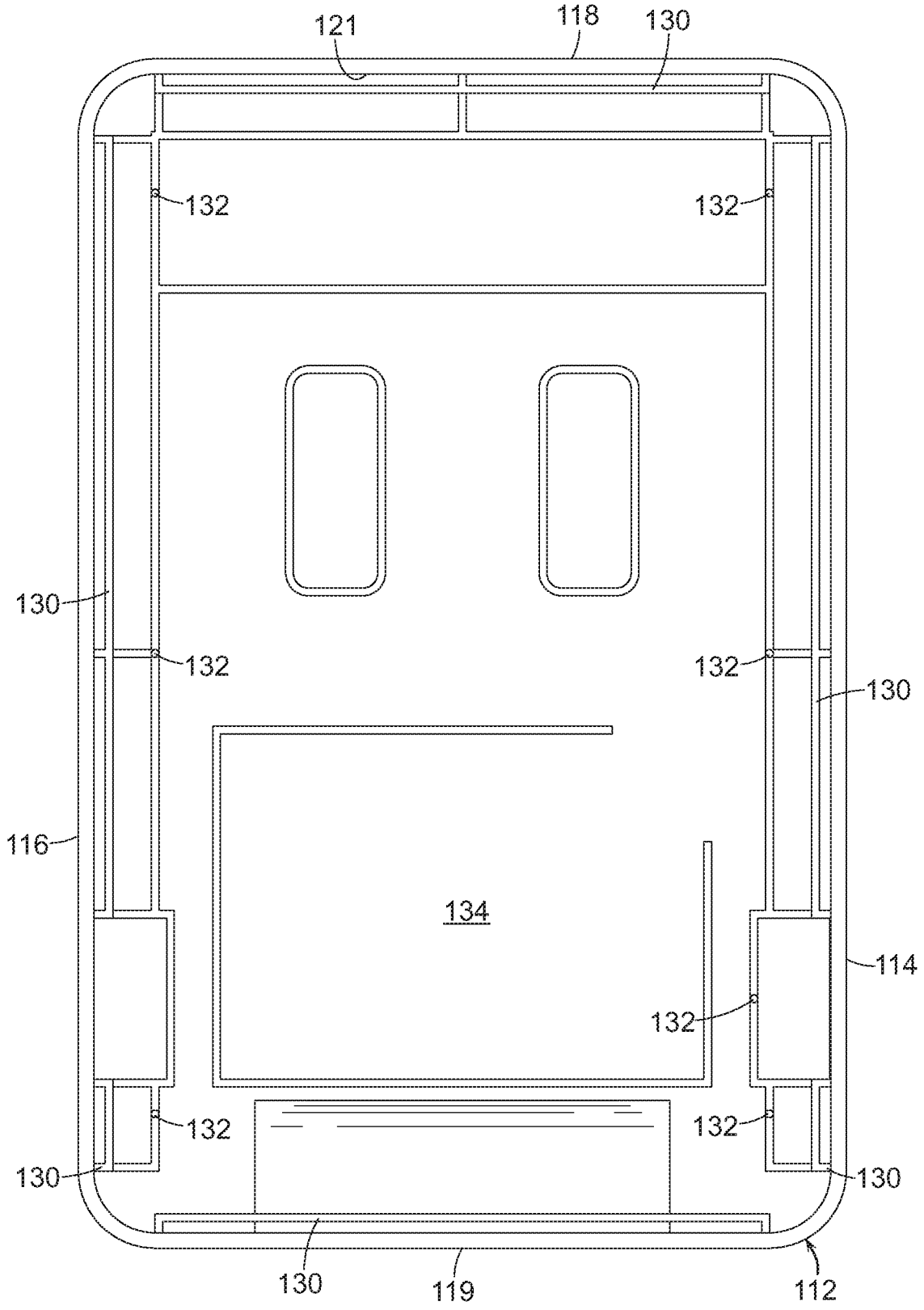
FIG. 9 is a top plan view of the housing.
Figure 10:
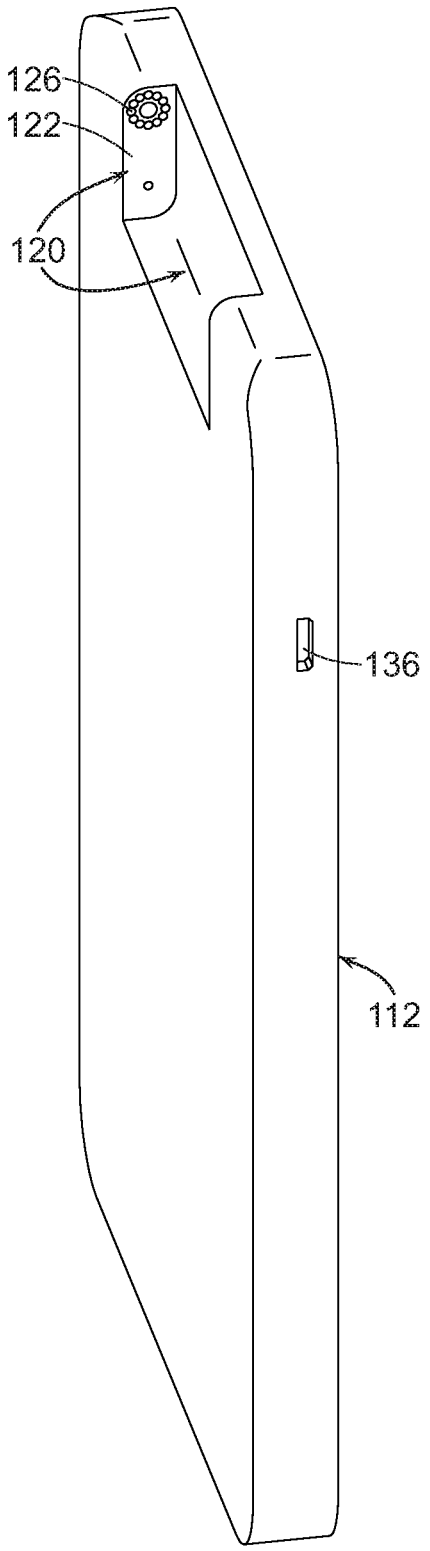
FIG. 10 is a rear perspective view of the housing of the lighted mirror unit showing a cavity with in-dents on a left sidewall of the cavity that mate with the out-dents on the left end portion of the hinge.
Figure 11:
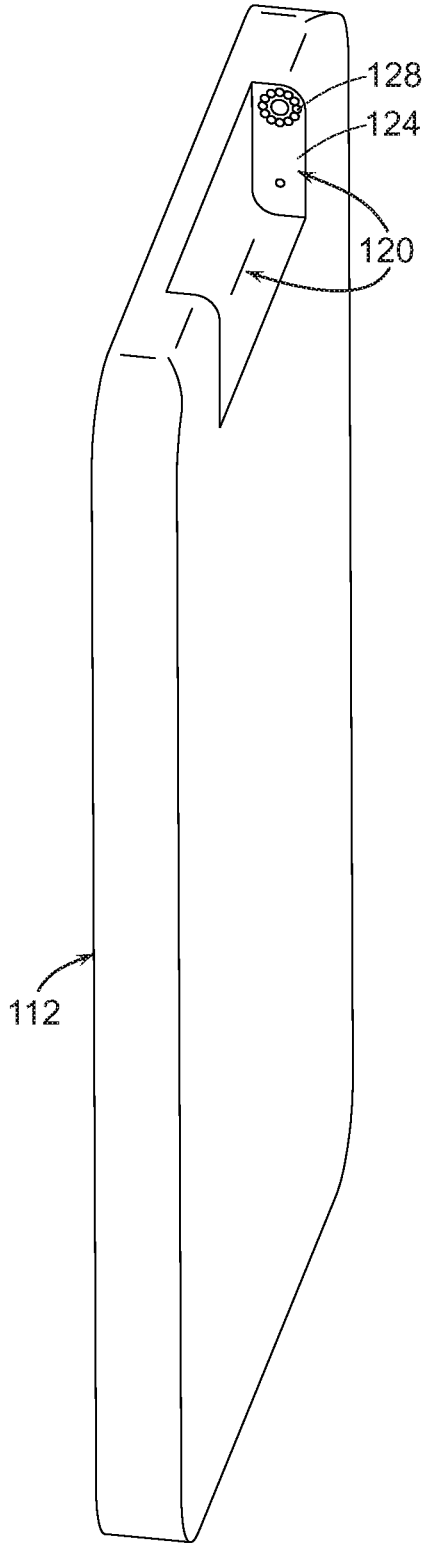
FIG. 11 is a rear perspective view of the housing of the lighted mirror showing the cavity with in-dents on a right sidewall of the cavity that mate with the out-dents on the right end portion of the hinge.

Referring to FIGS. 9-11, housing 112 comprises a left wall 116, a right wall 114, a bottom wall 119, and a top wall 118. Housing 112 further comprises an upper mounting portion or cavity 120 (FIGS. 10 and 11) that is rotatably engaged with hinge 90 of base unit 12. Cavity 120 comprises a left inner wall 122 and a right inner wall 124. Cavity 120 further comprises in-detents 126 formed on left inner wall 122. Cavity 120 further comprises in-detents 128 formed on right inner wall 124. Housing 112 further comprises a plurality of mirror mounting portions 130 secured to rear layer 142 of mirror 140 by conventional means such as adhesive. Housing 112 further comprises a plurality of posts or bosses 132 that engage with openings 152 to secure PCB 150. Housing 112 further comprises a compartment 134 to retain battery 170. Housing 112 further comprises opening 137 to receive USB connector 178. Housing 112 may be made from conventional materials such as plastic and fabricated by conventional molding processes.

Figure 12:
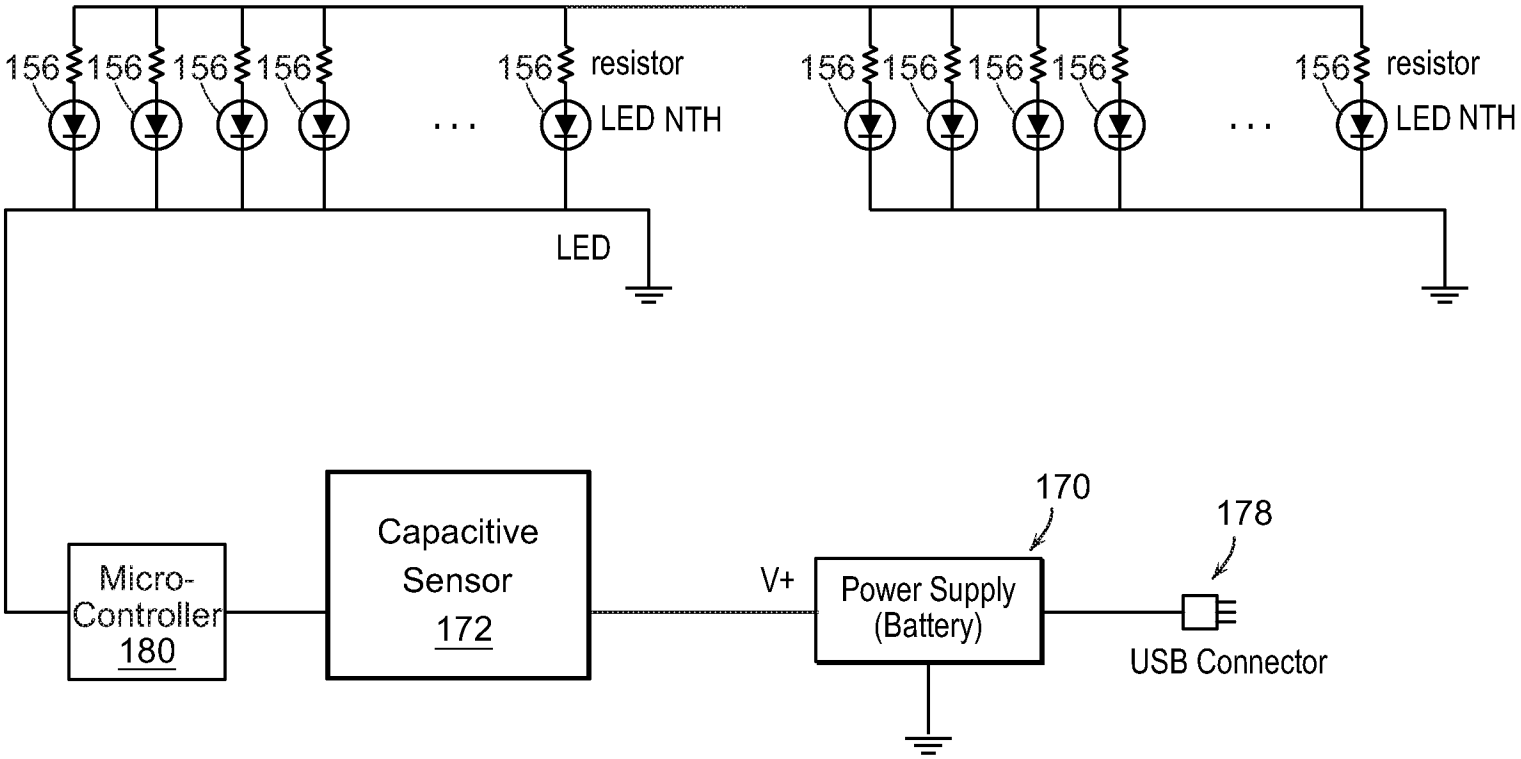
FIG. 12 is a high level block diagram showing the electro-mechanical and electrical components of the cosmetics case.

Referring to FIG. 12, where a high level schematic shows the electrical and electro-mechanical components of cosmetics case 10 mounted to and/or connected to each other by PCB 150. (FIG. 8) Micro-controller 180 has default state where light emitting diodes 156 are turned off A first touch of button mark 138 (FIGS. 1 and 2), and thus capacitive sensor 172, causes micro-controller 180 to turn on light emitting diodes 156 to a low intensity state. A second touch of button mark 138 (and thus sensor 162) causes micro-controller 180 to turn on light emitting diodes 156 to a medium intensity state. A third touch of button mark 138 (and thus sensor 172) causes micro-controller 180 to turn on light emitting diodes 156 to a high intensity state. A fourth touch of button mark 138 (and thus sensor 172) causes micro-controller 180 to turn off light emitting diodes 156.

With cosmetics case 10 of the present invention, a person can easily turn on light emitting diodes 156 by touching button mark 138 and move lighted mirror unit 110 to a desired position. Thereafter, the person may apply make-up from the pans of make-up 8 stored in compartment 16 with the aid of the mirror 140.

The foregoing description is intended primarily for purposes of illustration. This invention may be embodied in other forms or carried out in other ways without departing from the spirit or scope of the invention. Modifications and variations still falling within the spirit or scope of the invention will be readily apparent to those of skill in the art.

What is claimed:

1. A cosmetics case for storing and applying make-up from one or more pans of make-up, the cosmetics case comprising:

a base unit comprising a compartment for storing the pans of make-up and a hinge; and a lighted mirror unit comprising a mirror and a plurality of light sources adapted to emit light from said mirror; said lighted mirror unit being engaged with said hinge of said base unit between a closed position where said lighted mirror unit is resting upon said base unit with said mirror and said light sources facing away from said compartment and an open position where said compartment is exposed and said mirror and light sources face an open area above said compartment.

2. The cosmetics case of claim 1, further comprising a mounting portion comprising a hole and a cavity adapted to rotatably receive said hinge.

3. The cosmetics case of claim 2, wherein said base unit further comprises a retaining member engaged with said mounting portion; said retaining member comprising a hole and a cavity adapted to mate with said hole and said cavity of said mounting portion, respectively, to form a complete hole and a complete cavity to rotatably receive said hinge.

4. The cosmetics case of claim 3, wherein said lighted mirror unit further comprises a housing comprising a mounting cavity rotatably engaged with said hinge of said base unit.

5. The cosmetics case of claim 4, wherein said mounting cavity comprises a left inner sidewall and a right inner side wall; each of said left and right inner sidewalls comprise a plurality of in-dents; said hinge of said base unit comprises a left end portion and a right end portion; each of said left and right end portions comprise a plurality of out-dents that rotatably engage with said in-dents of said left and right inner side walls of said mounting cavity.

6. The cosmetics case of claim 5, wherein said mirror comprises a left side and a right side; said plurality of light sources being disposed about said left and right sides of said mirror.

7. The cosmetics case of claim 6, further comprising a micro-controller to control the light intensity of said plurality of light sources.

8. The cosmetics case of claim 7, further comprising a switch adapted to send a signal to said micro-controller to activate said light emitting diodes to a selected light intensity.

9. The cosmetics case of claim 8, wherein said switch comprises a capacitive touch sensor.

10. The cosmetics case of claim 1, wherein said base unit further comprises a magnetic floor engaged with the pans of make-up.

11. The cosmetics case of claim 10, wherein said magnetic floor is removably engaged with the pans of make-up.

12. The cosmetics case of claim 1, wherein said plurality of light sources comprise light emitting diodes.

* * * * *